US007298987B2

(12) United States Patent
Tokishige et al.

(10) Patent No.: US 7,298,987 B2
(45) Date of Patent: Nov. 20, 2007

(54) EXTERNAL COVER, AND IMAGE FORMING DEVICE AND CONTROL SYSTEM INCLUDING THE SAME

(75) Inventors: Kiyoshi Tokishige, Kyoto (JP); Naofumi Okada, Tenri (JP); Jinichi Nagata, Osaka (JP); Toshiki Ohgita, Nara (JP); Toyoaki Nanba, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 414 days.

(21) Appl. No.: 10/824,349

(22) Filed: Apr. 15, 2004

(65) Prior Publication Data

US 2004/0208669 A1 Oct. 21, 2004

(30) Foreign Application Priority Data

Apr. 17, 2003 (JP) ..... 2003-112698

(51) Int. Cl.
*G03G 15/00* (2006.01)

(52) U.S. Cl. ..... 399/107; 399/411

(58) Field of Classification Search ..... 399/107, 399/411

See application file for complete search history.

(56) References Cited

FOREIGN PATENT DOCUMENTS

| | | |
|---|---|---|
| JP | 10-133443 A | 5/1998 |
| JP | 2000-270133 A | 9/2000 |
| JP | 2002-182441 A | 6/2002 |

*Primary Examiner*—David M. Gray
*Assistant Examiner*—Ryan D. Walsh
(74) *Attorney, Agent, or Firm*—Birch, Stewart, Kolasch & Birch, LLP

(57) ABSTRACT

A connector cover of the present invention serves a function as a cover for a connector when a postprocessing device is not fitted to a main unit of an image forming device. Further, when the postprocessing device is fitted to the main unit of the image forming device, the connector cover is secured at the other position while maintaining the function as a cover for the connector, and serves a function as a shock-absorbing member with respect to the actuator which is provided in the postprocessing device. This makes it possible to secure a good appearance of the image forming device and make effective use of resources.

16 Claims, 6 Drawing Sheets

EXTERNAL COVER, AND IMAGE FORMING DEVICE AND CONTROL SYSTEM INCLUDING THE SAME

This Nonprovisional application claims priority under 35 U.S.C. § 119(a) on Patent Application No. 2003/112698 filed in Japan on Apr. 17, 2003, the entire contents of which are hereby incorporated by reference.

FIELD OF THE INVENTION

The present invention relates to an external cover included in a main unit of an image forming device or the like including printer, facsimile, and copier, and when an option device or the like is not fitted to the main unit, covering a connecting part (attaching part) between the main unit and the option device, e.g. paper-receiving port, and relates to an image forming device including the external cover.

BACKGROUND OF THE INVENTION

Conventionally, a peripheral device such as postprocessing device and large-capacity paper feeder (hereinafter referred to as option device) would be fitted to a main unit of an image forming device in response to user's demand.

Because of this, the main unit of the image forming device includes a communication part with the option device, e.g. a paper-receiving port for guiding sheets of paper received from the option device and a paper-feeding port for guiding sheets of paper to the option device. Also, the image forming device includes electrically connecting section and other sections relating to communication and power supply between the option device and the image forming device.

However, in the case where the option device is not fitted to the image forming device, it is necessary to improve the appearance of the image forming device and to prevent accidents at the communication part and other part. Therefore, the attaching section, such as the communication part and the electrically connecting section (a connecting part between the main unit of the device and the option device), is covered with an external cover for covering, a cover provided as an outer surface of the image forming device, or the like so that the attaching section is invisible or the attaching section is not usable.

In such an image forming device, after detaching the external cover for covering, or cutting off a portion of a cover provided as an outer surface of the image forming device as disclosed in Japanese Laid-Open Patent Application No. 10-133443/1998 (Tokukaihei 10-133443; published on May 22, 1998), the option device is fitted to the main unit of the image forming device.

In Japanese Laid-Open Patent Application No. 10-133443/1998, the cut-off portion, which serves another function, is reused without being thrown away. With this arrangement, effective use of resources is attempted.

However, in an image forming device as described in Japanese Laid-Open Patent Application No. 10-133443/1998, the following problem arises when the image forming device is used independently from the option device: when a portion of the cover provided as the outer surface of the image forming device is cut off, the outer surface of the image forming device is kept exposed with its original form lost, degrading appearance of the image forming device.

Further, when the cover provided as the outer surface of the image forming device is replaced with a new one, the problem that maintenance cost occurs arises.

Japanese Laid-Open Patent Application No. 2002-182441 (Tokukai 2002-182441; published on Jun. 26, 2002) discloses that parts removed from a main unit of a device before the option device is fitted to the main unit are made usable as a functioning component of the option device. In addition, Japanese Laid-Open Patent Application No. 2002-182441 discloses that the parts removed from the main unit of the device can be reattached to the main unit of the device after the option device is separated from the main unit of the device. Note that, as a usage example of the parts removed from the main unit of the device as the functioning component of the option device, given is a paper stopper for a paper feed tray. However, although the parts removed from the main unit of the device can be used as a functioning component of the option device, the removed parts are a supplementary component of the option device, not essential component for the option device. Therefore, some users might not use the parts removed from the main unit of the device as a functioning component of the option device. On this account, there is the possibility that the parts removed from the main unit of the device would be lost when the option device is fitted to the main unit of the device.

Further, Japanese Laid-Open Patent Application No. 2000-270133 (Tokukai 2000-270133; published on Sep. 29, 2000) discloses that in the image forming device, an external cover corresponding to the part where an additional option device is fitted is a partial cover being attachable/detachable to/from the external cover, and the partial cover can be attached in an inverted position in the vertical direction or horizontal direction, depending on whether or not the option device is fitted to the image forming device. However, the partial cover has only the function as a cover when the option device is attached or is not fitted to the image forming device. Further, in the image forming device, when the part where the additional option device is fitted is located between the image forming device and the additional option device, the attaching part is covered by the option device. This eliminates the necessity to cause the partial cover to function as a cover when the option device is fitted, and the partial cover might not be attached to the image forming device, depending on a user. Because of this, there is the possibility that the partial cover would be lost.

SUMMARY OF THE INVENTION

The present invention has been attained in view of the above problem, and a feature of the present invention is to provide an external cover capable of securing its good appearance and effective use of resources and being less likely to be lost than a conventional external cover, and an image forming device and a control system including the external cover.

In accordance with the above feature, an external cover of the present invention is an external cover covering an attaching section which is provided in a main unit of a first device to fit a second device to the main unit of the first device, the external cover, when the second device is not fitted to the main unit of the first device, serves a first function as a cover for the attaching section, and the external cover, when the second device is fitted to the main unit of the first device, serves a second function which is different from the first function while maintaining the first function, such that the external cover is provided to the first device or the second device in a state different from a state when the second device is not fitted to the main unit of the first device.

According to the above arrangement, the external cover has a first function of covering an attaching section (a part connecting between the main unit of the first device and the second device) provided in the main unit of the first device. To realize system expansion by fitting the second device to the main unit of the first device, the external cover having been provided as a cover for the attaching section is reused, serving a new function (second function) while maintaining the first function as a cover. Therefore, even when the second device is fitted to the main unit of the first device, the external cover is necessary for the first device or the second device. This eliminates loss of the external cover. In the case where the second device is separated from the first device so as to get back to a state where the first device is independent from the second device, the external cover can be reattached to the main unit of the first device, functioning as a cover for the attaching section. This makes it possible to secure a good appearance of the first device, to make effective use of resources, and to provide an external cover with no risk of being lost.

For a fuller understanding of the nature and advantages of the invention, reference should be made to the ensuing detailed description taken in conjunction with the accompanying drawings.

DESCRIPTION OF THE EMBODIMENTS

First Embodiment

Figure 1:
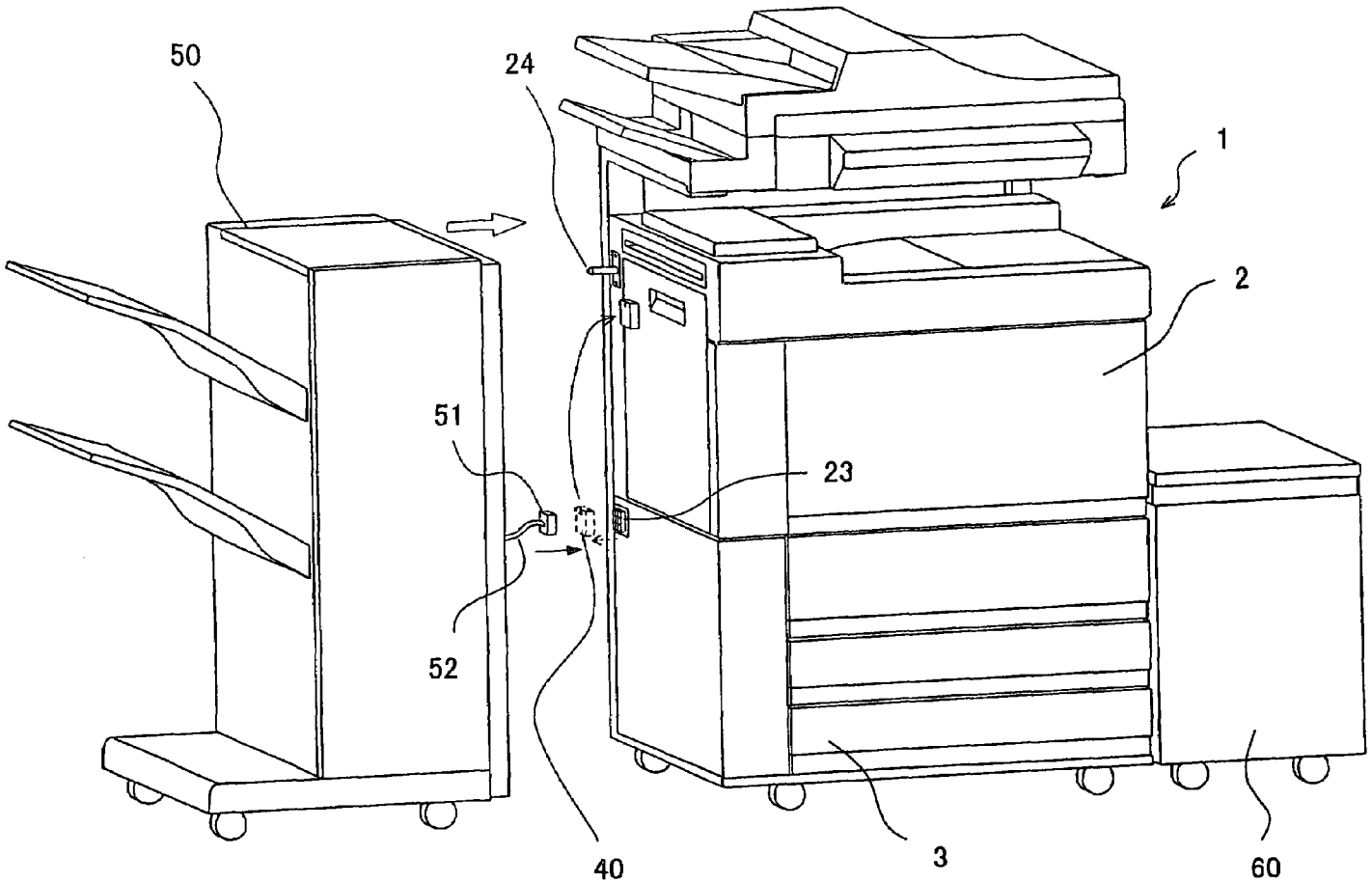
FIG. 1 is an outside and perspective view illustrating an external cover according to one embodiment of the present invention, an image forming device, and a postprocessing device, when the postprocessing device is fitted to the image forming device.
Figure 2:
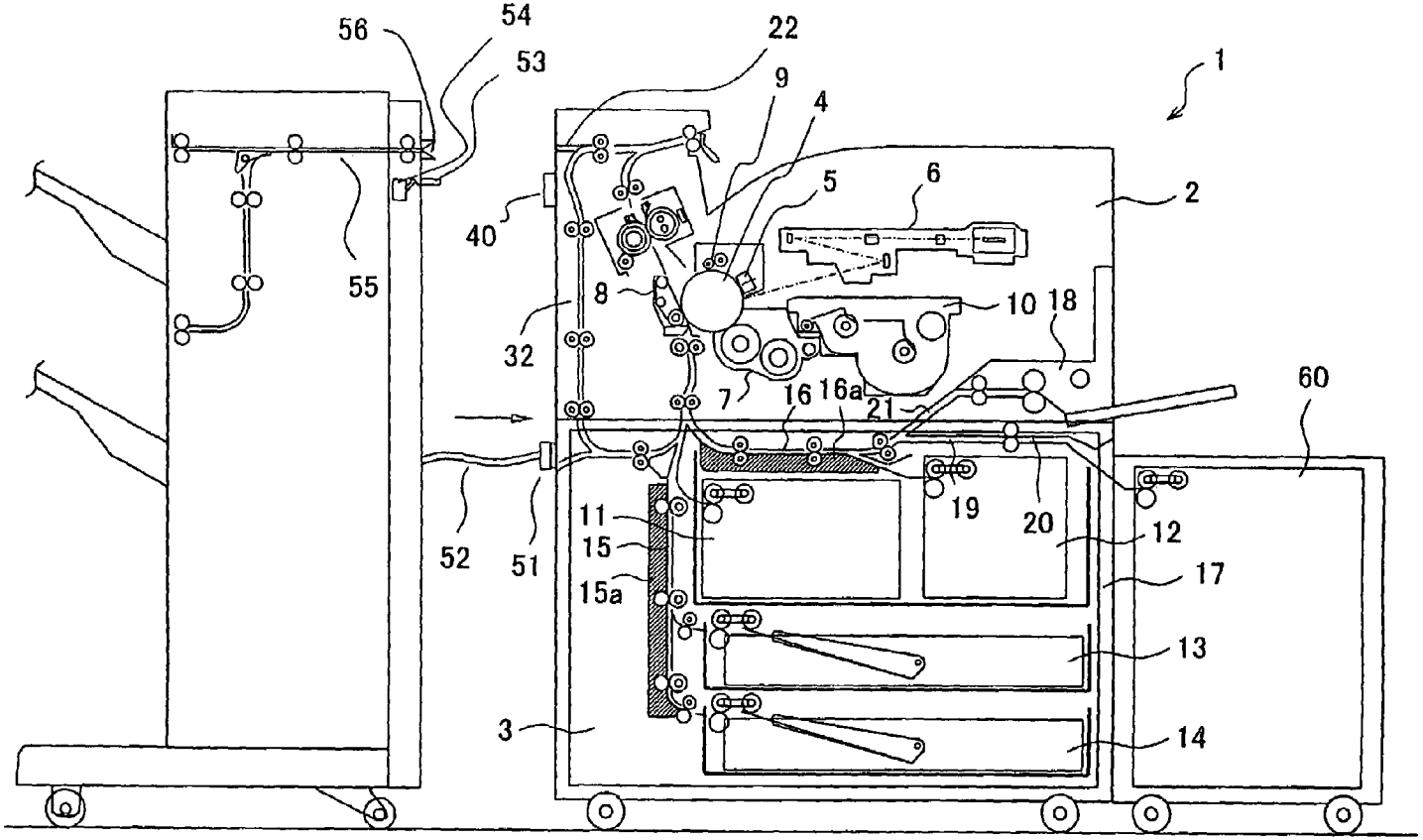
FIG. 2 is a cross-sectional view illustrating an external cover according to one embodiment of the present invention, an image forming device, and a postprocessing device, when the postprocessing device is fitted to the image forming device.

The following will describe one embodiment according to the present invention with reference to FIGS. 1 and 2.

FIG. 1 is an outside and perspective view illustrating an image forming device, a postprocessing device as option device, and an external cover when the postprocessing device is fitted to the image forming device.

As illustrated in FIG. 1, a postprocessing device having stapling function, punching function, and other functions (second device) 50 is fitted to an image forming device (first device) 1 on the paper ejection side (the side shown in the left-hand part of FIG. 1). A postprocessing device (second device) 50 is a device for extending a system of the image forming device 1. Further, a large-capacity paper feeder 60 is fitted to the other side of the image forming device 1 (the side shown in the right-hand part of FIG. 1). The large-capacity paper feeder 60 will be described later in the Second Embodiment.

As illustrated in FIG. 1, the image forming device 1 of the present embodiment includes a printer section (image forming section) 2 and a paper feed unit 3 placed under the printer section 2.

To the side surface of the paper feed unit 3 facing the postprocessing device 50 (the side shown in the left-hand part of FIG. 1), a connector (attaching section) 23 and a connector cover (external cover) 40 for covering the connector 23 are provided. Further, to the side surface of the printer section 2 facing the postprocessing device 50, a positioning boss 24 is provided.

The postprocessing device 50 has a cable 52 including a connector 51 at its end, on the side surface facing the postprocessing device 50.

Connection between the connector 23 and the connector 51 allows the postprocessing device 50 to communicate with the image forming device 1 and to receive a power supply from the image forming device 1.

Further, the connector cover 40 is an external cover which is secured with a screw or the like to the image forming device 1 so as to cover the connector 23 while the option device such as the postprocessing device 50 is not fitted to the image forming device. At this moment, the connector cover 40 serves a function as a cover for the connector 23 that is the attaching section (a connecting part between the image forming device 1 and the postprocessing device 50) (first function). That is, the connector cover 40 forms a portion of an outer surface of the image forming device 1. This arrangement enhances the appearance of the image forming device 1. Moreover, the connector cover 40 protects the connector 23 from externally given physical shocks.

In the case where the postprocessing device 50 is fitted to the image forming device 1, the connector cover 40 is detached from the paper feed unit 3, and the connector 23 is exposed. The detached connector cover 40 is secured with a screw to the side surface of the printer section 2 facing the postprocessing device 50, which is apart from the connector 23. Here, the connector cover 40 is arranged so as to be reattached to cover the connector 23, without losing the function as a cover for the connector 23.

The positioning boss 24 is one for constantly maintaining relative positions between the image forming device 1 and the postprocessing device 50 when the postprocessing device 50 is fitted to the image forming device 1. Constant relative positions are positions where the image forming device 1 and the postprocessing device 50 can perform normal operation as a series of devices. More specifically, constant relative positions are positions where a paper transport path of the image forming device 1 is connected to a paper transport path of the postprocessing device 50 so that paper delivery is possible between the image forming device 1 and the postprocessing device 50. The relative positions are described with reference to FIG. 2.

FIG. 2 is a cross-sectional diagram of the image forming device 1 and the postprocessing device 50 when they are cable-connected with the connectors 23 and 51. Note that, the image forming device 1 is fitted to the large-capacity paper feeder 60 on the right side of the image forming device 1. The large-capacity paper feeder 60 will be described in the Second Embodiment.

On the side of the postprocessing device 50 facing the image forming device 1 provided are a paper-receiving port 56 for receiving a sheet of paper from the image forming device 1, and a detector 54 including an actuator 53. A sheet of paper entering the paper-receiving port 56 is guided by a transport path 55 and is subjected to a predetermined process.

Further, as indicated by an arrow in FIG. 2, the postprocessing device 50 is moved toward the image forming device 1, and the postprocessing device 50 is fitted to the image forming device 1. While the postprocessing device 50 is fitted to the image forming device 1, the connector cover 40 is secured with a screw to a predetermined position of the printer section 2 so that the actuator 53 strikes the connector cover 40.

Inside the printer section 2 provided is a transport path 22. The transport path 22 is one for transporting a sheet of paper including an image formed thereon to the postprocessing device 50, and is directly connected to a paper-feeding port.

When the postprocessing device 50 is fitted to the image forming device 1 so that they maintain the constant relative positions in accordance with the positioning boss 24 provided to the image forming device 1 (see FIG. 1), the transport path 22 of the printer section 2 is connected to the transport path 55 of the postprocessing device 50. At the same time, the actuator 53 strikes the connector cover 40 secured with a screw to a predetermined position of the printer section 2.

When the actuator 53 strikes the connector cover 40 secured with a screw to a predetermined position of the printer section 2, the detector 54 recognizes that the postprocessing device 50 is properly fitted to the image forming device 1. That is, the detector 54 and the actuator 53 are one of object determination means for determining whether or not an object exists at the end part of the actuator 53.

Further, the present embodiment has a control system including a control circuit (not shown) for controlling operations of the image forming device 1 and the postprocessing device 50.

In the present control system, when the detector 54 determines that there exists any object at the end part of the actuator 53, the control circuit is set so as to operate the image forming device 1 and the postprocessing device 50 in response to a signal from the detector 54. On the other hand, in the present control system, when the detector 54 determines that no object exists at the end part of the actuator 53, the control circuit is set so as not to operate the image forming device 1 and the postprocessing device 50.

Therefore, when the postprocessing device 50 is fitted to the image forming device 1 without the connector cover 40, having been detached from the connector 23, attached to a predetermined position to cause the connector cover 40 to function as an shock-absorbing member with respect to the actuator 53, the detector 54 determines that no object exists at the end part of the actuator 53. That is, the detector 54 determines that the postprocessing device 50 is separated from the printer section 2. At this moment, in the control system, the control circuit causes the image forming device 1 and the postprocessing device 50 not to operate.

Thus, in the case where the postprocessing device 50 is fitted to the image forming device 1, the connector cover 40 detached from the connector 23 is not thrown away and lost mistakenly because the connector cover 40 is an essential component.

Further, when a paper jam occurs in the transport path 32 inside the printer section 2, a part located in the vicinity of the transport path 32 on the side surface of the printer section 2 facing the postprocessing device (a part shown in the left-hand part of FIG. 2) must be open to clear a paper jam. Because of this, the postprocessing device 50 must be separated from the image forming device 1, and the actuator 53 does not strike the connector cover 40 at the same time. At this moment, the present control system causes the image forming device 1 and the postprocessing device 50 not to operate, which can prevent user's hands and other parts from getting caught in the image forming device 1 and prevent other troubles.

Further, in the case where the postprocessing device 50 is separated from the image processing device 1 due to the unnecessity of the postprocessing device 50 as option device, the connector cover 40 having functioned as a shock-absorbing member with respect to the actuator 53 is reattached so as to cover the connector 23, as a cover for the connector 23.

With this arrangement, after the postprocessing device 50 is separated from the image forming device 1, it is possible to return the appearance of the image forming device 1 to its good appearance without exposure of the connector 23.

Further, since the connector cover 40 functions as a shock-absorbing member with respect to the actuator 53, the connector cover 40 also has a function of protecting the side surface of the image forming device 1 from damage caused by the actuator 53. Thus, the side surface of the image forming device 1 is protected by the connector cover 40 without being disfigured its appearance. Therefore, after the postprocessing device 50 is separated from the image forming device 1, the side surface of the image forming device 1 is hardly degraded its appearance.

Thus, while the postprocessing device 50 is fitted to the image forming device 1, the connector cover 40 is attached, as a shock-absorbing member with respect to the actuator 53, to the printer section 2. On the other hand, while the postprocessing device 50 is not fitted to the image forming device 1, the connector cover 40 is attached as a cover for the connector 23. That is, it is possible to freely change between the functions of the connector cover 40, depending on whether or not the postprocessing device 50 is fitted to the image forming device 1.

More specifically, the connector cover 40, which is one of the embodiments in the present invention, serves a function as a cover for the connector 23 (first function), which is an attaching section (a connecting part between the image forming device 1 and the postprocessing device 50), while the postprocessing device 50 is fitted to the image forming device 1. Further, the connector cover 40 serves a function as a shock-absorbing member with respect to the actuator 53 (second function) included in the detector 54 while the postprocessing device 50 is fitted to the image forming device 1.

Next, the following will describe the printer section 2, the paper feed unit 3 placed under the printer section 2.

Substantially at the central position of the printer section 2 located is a xerographic process section centrally having a photoconductive drum 4. More specifically, the xerographic process section includes a charging unit 5, a light scanning unit 6, a development unit 7, a transfer unit 8, and a cleaning unit 9 located around the photoconductive drum 4.

The charging unit 5 is one for electrically charging the photoconductive drum 4 evenly. The light scanning unit 6 is one for scanning an optical image and writing an electrostatic latent image on the photoconductive drum 4 electrically charged evenly. The development unit 7 is one for developing the electrostatic latent image written by the light scanning unit 6 with a developer.

The transfer unit 8 is one for transferring an image recorded and reproduced on the photoconductive drum 4 onto a recording medium. The cleaning unit 9 is one for removing the residual developer remaining on the photoconductive drum 4 so that a new image can be recorded on the photoconductive drum 4.

Note that, the residual developer removed by the cleaning unit 9 is collected and reused by a developer supplying section 10 of the developement unit 7. Note that, an image forming device of the present invention, not limited to an image forming device including such a process of reusing the residual developer, includes an image forming device collecting and disposing of the residual developer.

Next, the following will describe the paper feed unit 3. The paper feed unit 3 includes a plurality of paper feed trays (recording media supplying section) 11, 12, 13, and 14. Inclusion of these paper feed trays 11, 12, 13, and 14 allows the paper feed unit 3 to contain various sheet of papers, as recording media, divided for each size.

The image forming device 1 selects one tray from among the paper feed trays 11, 12, 13, and 14. Then, the image forming device 1 takes one sheet each from sheets of paper in the selected tray and supplies between the photoconductive drum 4 and the transfer unit 8. Subsequently, the transfer unit 8 transfers an image recorded and reproduced on the photoconductive drum 4 onto a supplied paper.

Now, the following will describe the paper feed trays 11 through 14 in details. The paper feed tray (first recording media supplying section) 11 and the paper feed tray (second recording media supplying section) 12 are placed parallel to each other. The paper feed tray 13 is placed under the paper feed trays 11 and 12, and further the paper feed tray 14 is placed under the paper feed trays 13.

Further, the capacity of the paper feed tray 13 is substantially as large as that of the paper feed tray 14. Moreover, the capacity of the paper feed trays 11 and 12 are set to be larger than that of the paper feed tray 13 or 14.

Then, the paper feed unit 3 includes transport paths 15 and 16 for transporting sheets of paper contained in the paper feed trays 11, 12, 13, and 14 toward the printer section 2. Note that, the transport path 15 is one for transporting sheets of paper contained in the paper feed trays 11, 13, and 14 toward the printer section 2, and the transport path 16 is one for transporting sheets of paper contained in the paper feed tray 12 toward the printer section 2.

Further, the transport path 15 extends in the perpendicular direction along a frame 17 of the paper feed unit 3. On the other hand, the transport path 16 extends in the horizontal direction along the frame 17.

Therefore, the paper feed trays 11 through 14 and the transport paths 15 and 16 are efficiently placed inside the paper feed unit 3, which realizes saving in space of the paper feed unit 3.

Note that, to load sheets of paper in the paper feed tray 11, 12, 13, or 14, a target paper feed tray selected from among the paper feed trays 11, 12, 13, and 14 is pulled out in the front direction of the main unit of the image forming device 1.

When a paper jam occurs in the transport path 15, a sheet of paper jammed in the transport path 15 is cleared by moving a guide 15*a* (the diagonally shaded areas in FIG. 2), which constitutes the transport path 15, toward the user with respect to the back of the paper feed unit 3 as a supporting point. Note that, such paper-removing operation is performed using a working space previously secured between the transport path 15 and the frame 17.

Also, when a paper jam occurs in the transport path 16, a sheet of paper jammed in the transport path 16 is cleared by moving a guide 16*a* (the diagonally shaded areas in FIG. 2), which constitutes the transport path 16, toward the user with respect to the back of the paper feed unit 3 as a supporting point. Note that, such paper-removing operation is performed in a circumstance where a working space is secured under the transport path 16 by pulling out the paper feed trays 11 and 12 placed in parallel to each other toward the user.

Note that, the image forming device 1 of the present embodiment has an arrangement such that the paper feed trays 11 and 12 can be simultaneously pulled out. However, the present invention is not limited to this arrangement. The image forming device 1 of the present embodiment may have an arrangement such that the paper feed trays 11 and 12 can be independently pulled out. In this case, it is safe that a working space where a sheet of paper jammed in the transport path 16 is cleared is secured under the transport path 16 by pulling out the paper feed tray 11 toward the user.

A manual paper feed unit (third recording media supplying section) 18 where a relatively small amount of sheets of paper is loaded is provided on the downstream side of the transport path 16. There is a high possibility that special sheets of paper would be loaded in the manual paper feed unit 18. This is because replacing with another type of sheet of paper or loading sheets of paper can be easily performed with respect to the manual paper feed unit 18. It is arranged such that a sheet of paper is supplied from the manual paper feed unit 18 to the transport path 16 via a transport path 21.

The above description has been given based on the connector cover 40 as external cover according to the First Embodiment. However, the connector cover 40 can be altered as follows.

A way of securing the connector cover 40 to the image forming device 1, not limited to a way of securing with screws, may be any ways provided that the connector cover 40 is secured to the image forming device 1. The connector cover 40 may be secured to the image forming device 1 by hook connection or by using a magnet.

In the present embodiment, when the postprocessing device 50 is fitted to the image forming device 1, the connector cover 40 is secured on the side surface of the image forming device 1. However, the place where the connector cover 40 is secured is not limited to the side surface. For example, under a circumstance where the postprocessing device 50 is fitted to the image forming device 1, in the case where a protrusion with the actuator 53 provided to the postprocessing device 50 is located on the back surface of the image forming device 1, the connector cover 40 is attached to the back surface of the image forming device 1.

Further, in the above arrangement, when the actuator 53 provided to the postprocessing device 50 comes into contact with the connector cover 40 attached to the image forming device 1, the detector 54 recognizes that the postprocessing device 50 is properly fitted to the image forming device 1. However, the present invention is not limited to this arrangement, and may have any arrangement provided that constant relative positions maintained between two devices can be determined.

Further, in the above arrangement, the connector cover 40 comes into contact with both of the devices (the image forming device 1 and the postprocessing device 50). However, it is not necessarily required that the connector cover 40 comes into contact with both of the devices. For example, the present invention may be arranged so that the postprocessing device 50 has a distance measuring device for measuring a distance from an object by means of light, and a reflection mirror is provided to a part of the connector cover 40. The distance measuring device is one of object determination means since the distance measuring device determines in accordance with an obtained measured value whether or not there is any object at a predetermined distance. At this moment, light emitted in a predetermined direction from the distance measuring device is reflected by a reflection mirror of the connector cover 40. The distance measuring device can detect the reflected light measure a distance between the postprocessing device 50 and the image forming device 1. The distance measuring device determines from the obtained measurement value whether or not the postprocessing device 50 and the image forming device 1 exist at predetermined relative positions.

Figure 7:
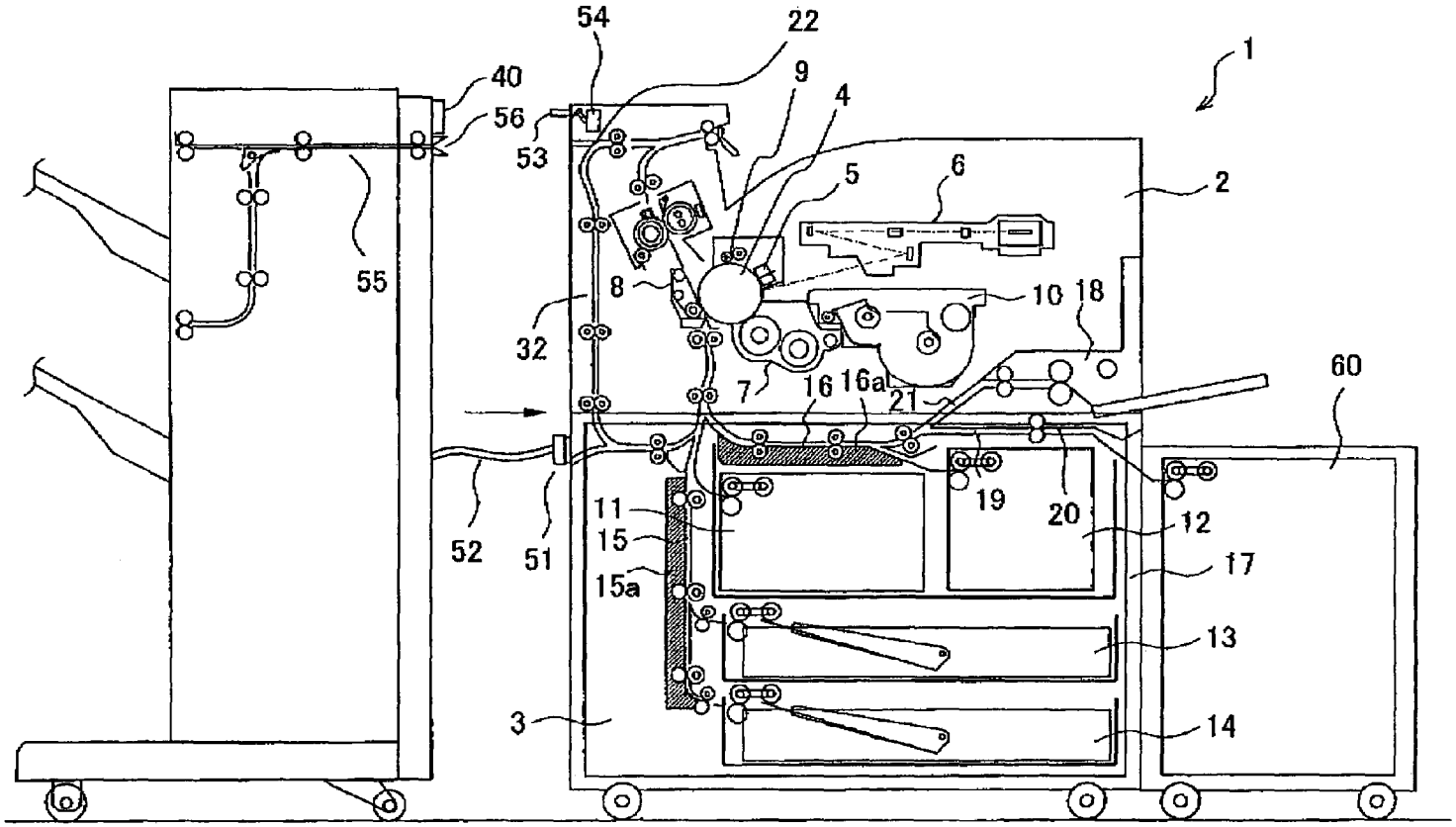
FIG. 7 is a cross-sectional view illustrating the external cover according to another embodiment of the present invention, the image forming device, and the postprocessing device, when the postprocessing device is fitted to the image forming device.

Still further, in the present embodiment, when the postprocessing device 50 including the actuator 53 and the detector 54 is fitted to the image forming device 1, the connector cover 40 is attached to a predetermined position of the image forming device 1. However, instead of the above arrangement, the present invention may have an arrangement such that when the postprocessing device 50 is fitted to the image forming device 1 including the actuator 53 and the detector 54, the connector cover 40 is attached to a predetermined position of the postprocessing device 50 (see FIG. 7). This arrangement can attain the same effects as the arrangement of the present embodiment.

Further, in the above control system, when the detector 54 determines that the postprocessing device 50 is not properly fitted to the image forming device 1, the control circuit controls the postprocessing device 50 and the image forming device 1 not to operate. However, the control circuit may control only the image forming device 1 not to operate. This is because, also in this case, the connector cover 40 is necessary when the postprocessing device 50 is fitted to the image forming device 1, which eliminates mistaken disposal and loss of the connector cover 40.

Further, the foregoing control system is working with the control circuit. However, the present system is not limited to this arrangement, and hence there is an alternative arrangement such that a program for carrying out the above-mentioned processes is recorded in a recording medium, and an information processing device which can read out the program and a digital signal output device operating under the control of the information processing device are used in place of the control circuit.

In this arrangement, an arithmetic unit (such as CPU and MPU) of the information processing device reads out the program recorded in the recording medium, and execute the processes. Thus, it is possible to consider that the processes are realized by the program itself.

As the above-mentioned information processing device, feature expansion boards and units attached to a computer can be adopted, apart from typical computers (such as work stations and personal computers).

The above-mentioned program is a program code of a software realizing the operations of the image forming device 1 and the postprocessing device 50 (e.g. an execute form program, intermediate code program, source program). The program may be self-contained, or used in combination with another program (e.g. an operating system).

After being read out from the recording medium, the program may be stored temporarily in a memory (such as a RAM) in the device, and then read out again and executed.

The recording medium in which the program is recorded may be easily detachable from the information processing device, or may be fixed (attached) to the device. Alternatively, the recording medium may be an external memory unit connected to the device.

As such a recording medium, the followings may be adopted: magnetic tapes such as a vide tape and cassette tape, magnetic disks such as a Floppy® disk and hard disk, optical disks such as a CD-ROM, MO, MD, DVD, and CD-R, memory cards such as an IC card and optical card, and semiconductor memories such as a mask ROM, EPROM, EEPROM, and flash ROM.

Also, a recording medium connected to the information processing device via a network (e.g. intranet and the Internet) may be adopted. In this case, the information processing device downloads the program via the network. That is to say, the program may be obtained through a transmission medium (a medium fluidly carrying the program) on a network (connected to a wired/wireless line). Note that, a program for downloading is preferably stored in the information processing device (or in the image forming device) in advance.

Second Embodiment

The following will describe another embodiment according to the present invention with reference to FIGS. 2 through 6. Note that, for the purpose of explanation, members having the same functions as those described in the First Embodiment are given the same reference numerals and explanations thereof are omitted here.

As illustrated in FIG. 2, the paper feed unit 3 of the image forming device (first device) 1 is fitted (connected) to the large-capacity paper feeder (second device) 60 as a fourth recording medium supplying section. The capacity of the large-capacity paper feeder 60 is set to be larger than those of other paper feed trays 11 through 14. A sheet of paper fed from the large-capacity paper feeder 60 passes through a transport path 20 and is guided to the printer section 2 through the transport path 19 and the transport 16. Note that, the transport path 20 is a transport path, provided to the paper feed unit 3, for first receiving a transporting target such as paper and overhead transparency from the large-capacity paper feeder 60. Therefore, the transport path 20 is located in the vicinity of the side surface of the image forming device 1 facing the large-capacity paper feeder 60.

Figure 3:
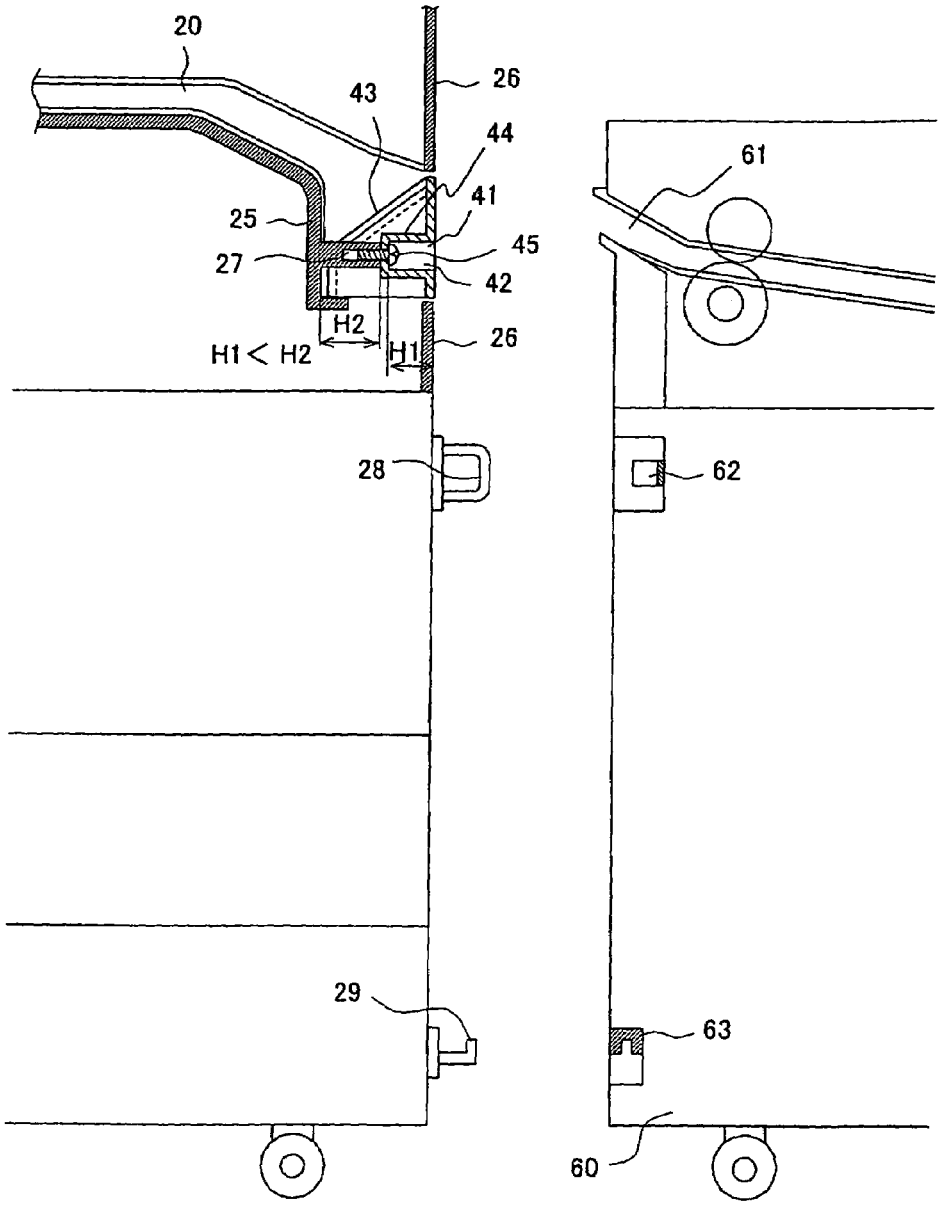
FIG. 3 is a cross-sectional view illustrating an external cover according to another embodiment of the present invention, an image forming device, and an option device, when the option device is not fitted to the image forming device.

FIG. 3 is a cross-sectional view illustrating the large-capacity paper feeder 60 and the image forming device 1 before the large-capacity paper feeder 60 is fitted to the image forming device 1. In the image forming device 1, a cover member (external cover) 41 is secured with screws to a cover support member 25 of the paper feed unit 3 so as to close the transport path 20 of the paper feed unit 3. The cover member 41 is a member having a rectangular board as a base taking the shape of an opening of the transport path 20 (paper receiving port 30 described later), and has a front surface of the base (front side) and a back surface of the base (back side) of respectively different shapes. Note that, FIG. 3 is a view illustrating a state where the cover member 41 is attached to the image forming device 1 so that the front surface of the base of the cover member 41 faces the outside of the image forming device 1.

Figure 5:
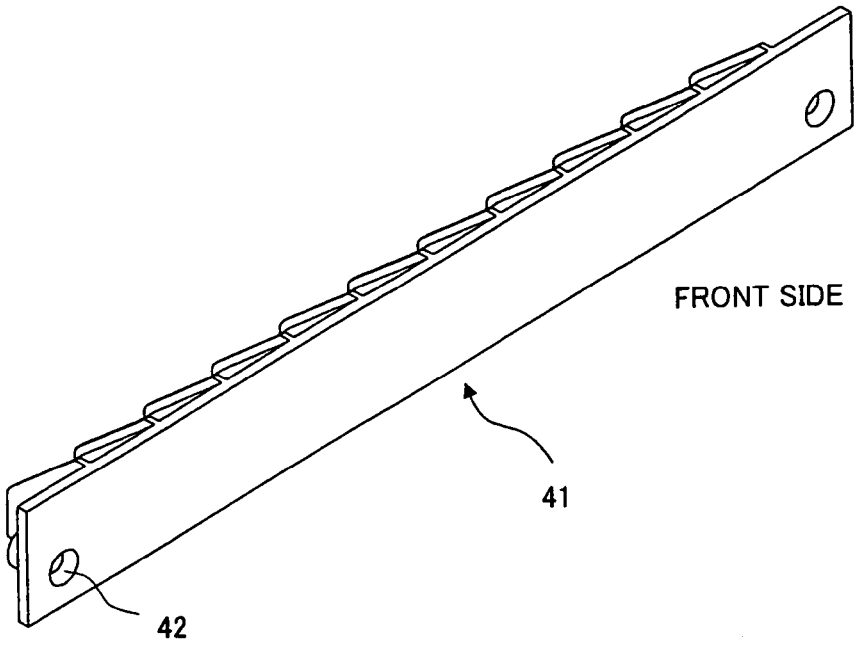
FIG. 5 is an outside and perspective view of the external cover according to another embodiment when viewed from the front side thereof.

FIG. 5 is a perspective view of the cover member 41 when the cover member 41 is viewed from its front surface of the base. As illustrated in FIG. 5, the front surface of the base is a smooth surface and includes two recessed sections 42 provided on the both ends in the width direction of a transported sheet and through which the cover member 41 is attached with screws.

As illustrated in FIG. 3, a depth H1 of the recessed section 42 is set so that when the cover member 41 is fixed to the cover support member 25 in such a direction that the front surface of the base of the cover member 41 faces outside, the front surface is flush with a right-side surface 26 of the image forming device 1.

Further, the front surface of the base is shaped to close the opening of the transport path 20, and when the cover member 41 is attached to the paper feed unit 3 in such a direction that the front surface of the base is exposed to the outside of the image forming device 1, the front surface of the base functions as a cover for the opening of the transport path 20 (paper receiving port 30 described later). This makes it possible to maintain a good appearance of the image forming device 1 without exposing the opening of the transport path 20.

Figure 6:
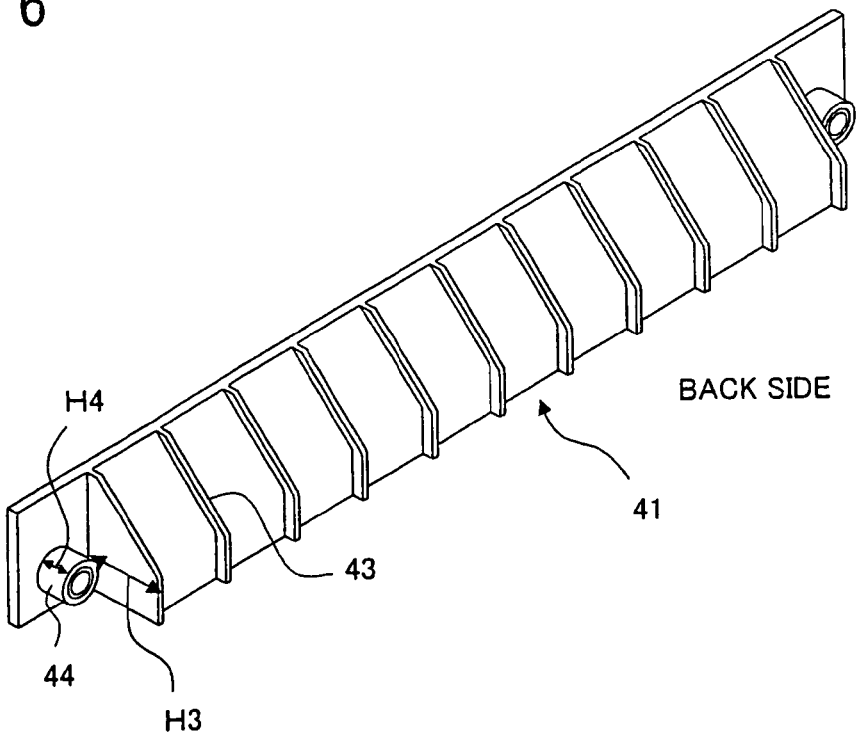
FIG. 6 is an outside and perspective view of the external cover according to another embodiment when viewed from the back side thereof.

FIG. 6 is a perspective view of the cover member 41 when the cover member 41 is viewed from the back side of the base. As illustrated in FIG. 6, the base is provided with a plurality of trapezoidal ribs 43 on its back surface, and the trapezoidal ribs 43 are arranged in parallel in the wide direction of the base. Further, a series of oblique lines of the ribs 43 form a slope with a predetermined angle with respect to the surface of the base.

Further, the base is provided on its back surface with two raised sections 44 through which the cover member 41 is attached with screws. Note that, the raised section 44 corresponds to the recessed section 42 provided on the front surface of the cover member 41 and through which the cover member 41 is attached with screws.

Here, as illustrated in FIG. 6, a distance from the base surface to the leading end of the rib 43 is denoted as H3, and a distance from the base surface to the top of the raised section 44 is denoted as H4.

Figure 4:
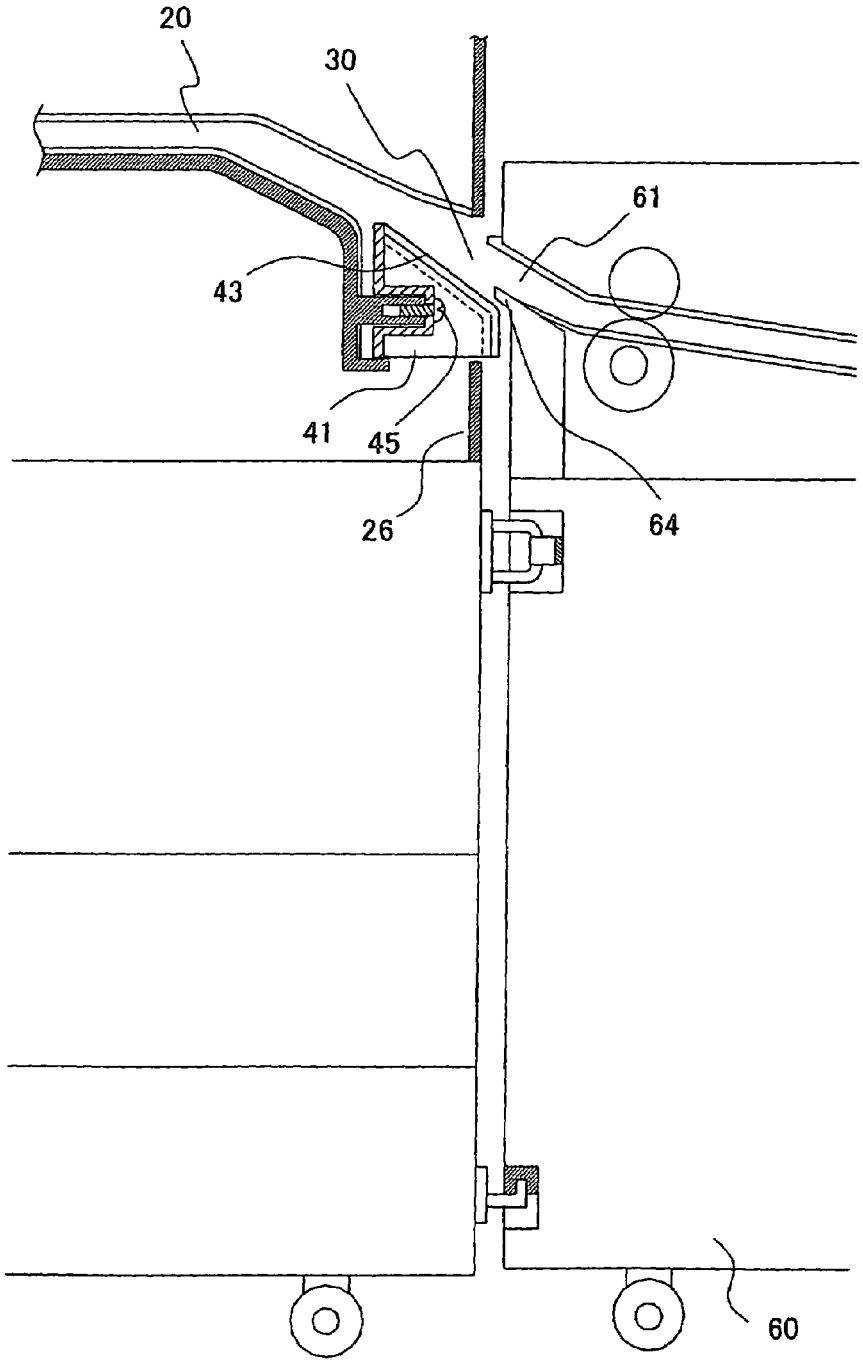
FIG. 4 is a cross-sectional view illustrating an external cover according to another embodiment of the present invention, an image forming device, and an option device, when the option device is fitted to the image forming device.

FIG. 4 is a cross-sectional view of the cover member 41, the image forming device 1, and the large-capacity paper feeder 60 when the large-capacity paper feeder 60 is fitted to the paper feed unit 3 of the image forming device 1.

To fit the large-capacity paper feeder 60 to the paper feed unit 3 of the image forming device 1, the cover member 41 having been attached to the cover support member 25 (see FIG. 3) with the screws 45 is detached therefrom. Thereafter, the cover member 41 is positioned in such a direction that its back surface is exposed to the outside of the image forming device 1 (in a direction opposite to such a direction that the front surface is exposed to the outside of the image forming device 1 in the present embodiment), and the cover member 41 is attached to the cover support member 25 with the screws 45 again. With this arrangement, as illustrated in FIG. 4, the paper receiving port (attaching section) 30 of the transport path 20 becomes open, and a sheet of paper fed from a paper-feeding port 61 of the large-capacity paper feeder 60 is guided to the transport path 20 of the paper feed unit 3. That is, the paper receiving port 30 of the paper feed unit 3 is coupled to the paper-feeding port 61 of the large-capacity paper feeder 60. This connects the image forming device 1 and the large-capacity paper feeder 60. At this moment, the slope formed with the ribs 43 on the back surface of the base of the cover member 41 functions as a guide surface for guiding a lower side of a transporting target such as a sheet of paper.

Under the circumstance where the large-capacity paper feeder 60 is fitted to the paper feed unit 3, if the cover member 41 is not attached to the cover support member 25, the guide surface does not exist in the paper feed unit 3. In this case, the transporting target is not fed from the large-capacity paper feeder 60 to the paper feed unit 3 because the transporting target is jammed in a section where the screw 45 is inserted or other section. Therefore, whenever the large-capacity paper feeder 60 is fitted to the paper feed unit 3, the cover member 41 is attached to the cover support member 25, which prevents loss of the cover member 41.

Note that, the transporting target is generally a medium on which images are formed by an image forming device, and more specifically the transporting target is a sheet such as paper and overhead transparency.

Here, as illustrated in FIG. 3, when a distance from the top of the raised section 44 to the leading end of the rib 43 is denoted as H2, H2 is expressed, using H3 and H4 illustrated in FIG. 6, by the following equation: H2=H3−H4. Note that, the cover member 41 is formed so that H2>H1 is satisfied. With this arrangement, as illustrated in FIG. 4, when the cover member 41 is attached to the cover support member 25 so that the back surface of the base of the cover member 41 faces the large-capacity paper feeder 60, a part of the cover member 41 (vicinity of the leading end of the rib 43) is in a state of being projected over the right-side surface 26 of the paper feed unit 3. The projected part is located at the lower side of a guide member 64 forming the paper-feeding port 61 of the large-capacity paper feeder 60. Note that, the guide member 64 has a function of guiding a transporting target at the paper-feeding port 61 of the large-capacity paper feeder 60.

More specifically, the cover member 41 provided to the image forming device 1 and the guide member 64 provided to the large-capacity paper feeder 60 overlap each other in the perpendicular direction. With this arrangement, the guide surface of the cover member 41 and the guide member 64 are continuously connected to each other without being disconnected, thus reliably guiding a transporting target such as a sheet of paper fed from the large-capacity paper feeder 60 to the paper feed unit 3.

As described previously, when the large-capacity paper feeder (second device) 60 is not fitted to the image forming device (first device) 1, the cover member 41 is attached to the image forming device 1 in such a direction that the front surface of the base of the cover member 41 is exposed to the outside of the image forming device 1. This makes the cover member 41 to function as a cover for the paper receiving port (attaching section) 30 (first function).

On the other hand, when the large-capacity paper feeder 60 is fitted to the image forming device 1, the cover member 41 is attached to the image forming device 1 in such a direction that the ribs 43 formed on the back surface of the base of the cover member 41 are exposed to the outside of the image forming device 1 (i.e. in a direction opposite to the foregoing direction). This makes the cover member 41 to function as a guide of a transporting target fed from the large-capacity paper feeder 60 (second function).

Note that, as illustrated in FIG. 3, on the right-side surface 26 of the image forming device 1 provided are a hook section 29 in the lower position and an eye section 28 in the upper position. Further, on the left-side surface of the large-capacity paper feeder 60 provided are a hook support member 63 in the lower position and a hook section 62 in the upper position.

The hook section 29 of the paper feed unit 3 is hooked on the hook support member 63 of the large-capacity paper feeder 60. Next, the upper part of the large-capacity paper feeder 60 is rotated toward the paper feed unit 3 upon the hook support member 63. With this arrangement, the hook section 62 of the large-capacity paper feeder 60 is engaged in the eye section 28 of the paper feed unit 3. As a result of this, the large-capacity paper feeder 60 is attached and secured to the paper feed unit 3.

When the large-capacity paper feeder 60 is unnecessary, the hook section 62 and the eye section 28 are unhooked from each other, and the hook support member 63 and the hook section 29 are unhooked from each other. This separates the large-capacity paper feeder 60 from the image forming device 1. Thereafter, the cover member 41 is attached to the cover support member 25 again so that the front surface of the base faces outside.

Thus, the function of the cover member 41 is freely changed between a cover and a sheet guide member, depending on whether or not the large-capacity paper feeder 60 is fitted to the image forming device 1.

Note that, the cover member 41 as external cover according to the Second Embodiment can be altered as follows.

The above arrangement has assumed that the cover member 41 is secured to the cover support member 25 with the screws 45. However, a way of securing the cover member 41 is not limited to a way of securing with screws. For example, the cover member 41 may be secured to the cover support member 25 by hook connection or by using a magnet.

Further, the following arrangement may be adopted: the cover member 41 includes a support axis, and the cover member 41 is rotatably secured to the cover support member 25 about the support axis. With this arrangement, it is possible to change between the surfaces respectively having functions, without detaching the cover member 41 from the image forming device 1.

As described above, in an external cover of an embodiment of the present invention is an external cover covering an attaching section which is provided in a main unit of a first device to fit a second device to the main unit of the first device, the external cover, when the second device is not fitted to the main unit of the first device, serves a first function as a cover for the attaching section, and the external cover, when the second device is fitted to the main unit of the first device, serves a second function which is different from the first function while maintaining the first function, such that the external cover is provided to the first device or the second device in a state different from a state when the second device is not fitted to the main unit of the first device.

According to the above arrangement, the external cover has a first function of covering an attaching section (a part connecting between the main unit of the first device and the second device) provided in the main unit of the first device. To realize system expansion by fitting the second device to the main unit of the first device, the external cover having been provided as a cover for the attaching section is reused, serving a new function while maintaining the first function as a cover. Therefore, even when the second device is fitted to the main unit of the first device, the external cover is necessary for the first device or the second device. This eliminates loss of the external cover. In the case where the second device is separated from the first device so as to get back to a state where the first device is independent from the second device, the external cover can be reattached to the main unit of the first device, functioning as a cover for the attaching section. This makes it possible to secure a good appearance of the first device, to make effective use of resources, and to provide an external cover with no risk of being lost.

Further, in addition to the above arrangement, an external cover of an embodiment of the present invention preferably has an arrangement such that one of the first device and the second device is provided with object determination means which determines whether or not there exists any object at a predetermined position, prior to fitting the second device to the main unit of the first device, the external cover is detached from the attaching section, and while the second device is fitted to the main unit of the first device, the external cover exists at the position thus determined by the object determination means, and is attached to an device which is not provided with the object determination means of the first device and the second device.

Here, the object determination means provided in the device is means for determining whether or not there exists any object at a predetermined position relative to the device. The predetermined position relative to the device can be expressed by a specific coordinate in the X-Y-Z coordinate system having the center of the device as an origin point.

According to the above arrangement, to fit the second device to the first device, the external cover is detached from the attaching section of the first device, and attached to another position of the first device, or any position of the second device. That is, this means that the external cover, which is an object, exists at a place where no object originally exists. Here, the position where the external cover is attached is set so as to correspond to a position at which the object determination means provided in the second device (or the first device) determines whether or not there exists any object, when the second device is properly fitted to the main unit of the first device. Therefore, on the basis of determination result obtained by the object determination means, the second device is fitted to the main unit of the first device, so that it is possible to determine whether or not relative positions between the first device and the second device are proper.

Further, in addition to the above arrangement, an external cover of an embodiment of the present invention preferably has an arrangement such that the external cover includes a plurality of surfaces, and when the external cover is attached to the first device, a function of the external cover is changed between the first function and the second function depending on which surface of the plurality of surfaces is exposed to outside of the first device.

According to the above arrangement, a surface of the external cover exposed to outside of the first device is different depending on whether or not the second device is fitted to the first device. Therefore, when the second device is not fitted to the main unit of the first device, one surface of the external cover exposed to outside the first device can serve a function as a cover for the attaching section (first function). When the second device is fitted to the main unit of the first device, the external cover can serve another function (second function) by causing the other surface to provide a shape having the second function and exposing the other surface of the external cover to outside of the first device. This makes it possible to allow the external cover to have a plurality of functions, and to avoid waste of resources without disposal of the external cover. In this case, a position where the external cover is attached to the main unit of the first device can be one and the same position regardless of whether or not the second device is fitted to the first device.

Still further, in addition to the above arrangement, an external cover of the present invention preferably has an arrangement such that while the second device is fitted to the main unit of the first device, a transporting target can be delivered between the main unit of the first device and the second device, and a surface of the external cover exposed to outside of the main unit of the first device serves the second function by guiding the transporting target to be transported.

According to the above arrangement, a transporting target which is delivered between the first device and the second device when the second device is fitted to the main unit of the first device can be guided (transported) smoothly.

Yet further, in addition to the above arrangement, an external cover of the present invention preferably has an arrangement such that the second device has a guide member which guides the transporting target to be transported, and when the second device is fitted to the main unit of the first device, the guide member and a surface of the external cover exposed to outside of the first device overlap each other.

According to the above arrangement, the first device and a part functioning as a guide member included in the second device overlap each other, thereby more reliably performing delivery of the transporting target between the first device and the second device.

Further, in addition to the above arrangement, an external cover of the present invention preferably has an arrangement such that the second function is a function associated with the second device.

According to the above arrangement, when the second device is fitted to the main unit of the first device to realize system expansion, the external cover is reused, serving a function associated with the second device having being fitted. On this account, the external cover is always necessary when the second device is fitted to the main unit of the first device, and is reused without being disposed, so that it is always possible to make effective use of resources.

Further, an image forming device of an embodiment of the present invention includes the external cover.

That is, an image forming device of an embodiment of the present invention is an image forming device including: an attaching section for fitting other device thereto; and an external cover covering the attaching section, when the other device is not fitted to the image forming device, the external cover serves a first function as a cover for the attaching section, and when the other device is fitted to the image forming device, the external cover serves a second function which is different from the first function while maintaining the first function, such that the external cover is provided to the image forming device or the other device in a state different from a state when the other device is not fitted to the image forming device.

This makes it possible to realize an image forming device allowing another second device (other device) to be fitted thereto, eliminating degradation its appearance when the other device is separated from the image forming device, facilitating effective use of resources in an economical way, and avoiding loss of the external cover.

Further, a control system of the present invention includes the first device, the second device, and the external cover, and is arranged such that if the external cover does not serve the second function when the second device is fitted to the main unit of the first device, at least the main unit of the first device, of the main unit of the first device and the second device, is caused not to operate.

More specifically, a control system of an embodiment of the present invention includes: a first device; a second device; and an external cover covering an attaching section which is provided in a main unit of the first device to fit a second device to the main unit of the first device, wherein: the external cover, when the second device is not fitted to the main unit of the first device, serves a first function as a cover for the attaching section, the external cover, when the second device is fitted to the main unit of the first device, serves a second function which is different from the first function while maintaining the first function, such that the external cover is provided to the first device or the second device in a state different from a state when the second device is not fitted to the main unit of the first device, and if the external cover does not serve the second function when the second device is fitted to the main unit of the first device, at least the main unit of the first device, of the main unit of the first device and the second device, is caused not to operate.

According to the above arrangement, if the external cover does not serve the second function when the second device is fitted to the main unit of the first device, at least the main unit of the first device does not operate. Because of this, the external cover is not mistakenly thrown away or lost. With this arrangement, after the second device is separated from the main unit of the first device, the external cover is reliably reattached as a cover for the attaching section to the first device. This makes it possible to avoid degradation in appearance of the main unit of the first device and to make effective use of resources.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A device which is a first device for fitting a second device thereto, the device, comprising:

an attaching section to which the second device is fitted; and a removable cover that can be entirely detached from a main unit of the first device, when the second device is not fitted to the main unit of the first device, the removable cover serving a first function as a cover for the attaching section, wherein one of the first device and the second device is provided with object determination means which determines whether or not there exists any object at a predetermined position, prior to fitting the second device to the main unit of the first device, the removable cover is entirely detached from the attaching section, while the second device is fitted to the main unit of the first device, the removable cover exists at the position determined by the object determination means, and is attached to a device which is not provided with the object determination means of the first device and the second device, and when the second device is fitted to the main unit of the first device, the removable cover serving a second function which is different from the first function, such that the removable cover is entirely detached from the first device at a location at which the removable cover serves as a cover for the attaching section and then reattached to one of either the first device and the second device in a state different from a state when the second device is not fitted to the main unit of the first device.

2. The device according to claim 1, wherein:

the object determination means is an actuator, and the second function is a function as a shock-absorbing member with respect to the actuator.

3. The device according to claim 1, wherein:

the second function is a function associated with the second device.

4. A control system comprising:

a first device;

a second device; and a removable cover covering an attaching section which is provided in a main unit of the first device to fit the second device to the main unit of the first device, wherein:

the removable cover, when the second device is not fitted to the main unit of the first device, serves a first function as a cover for the attaching section, the removable cover, when the second device is fitted to the main unit of the first device, serves a second function which is different from the first function, such that the removable cover is provided to the first device in a state different from a state when the second device is not fitted to the main unit of the first device, and if the removable cover does not serve the second function when the second device is fitted to the main unit of the first device, at least one of the main unit of the first device, and the main unit of the first device and the second device, is caused not to operate.

5. An image forming device comprising:

an attachment section at which said image forming device is connectable to an auxiliary device; and a removable cover attachable to said image forming device in a first manner to cover said attachment section and in a second manner to enable said image forming device and the auxiliary device to function together when the auxiliary device is connected to said image forming device, wherein said cover is adapted to engage an actuator on the auxiliary device when said cover is secured to said image forming device in the second manner and is to function as a shock absorbing device.

6. A method of selectively rendering operable an image forming device connected to an auxiliary device comprising the steps of:

providing an image forming device having an attachment section for attachment to an auxiliary device and an enablement section for supporting an element for enabling the joint operation of the image forming device and the auxiliary device;

attaching a removable cover at the attachment section;

providing an auxiliary device attachable to the image forming device;

removing the removable cover;

repositioning the removable cover and reattaching the removable cover at the enablement section; and attaching the auxiliary device to the imaging forming device such that the removable cover enables the joint operation of the image forming device and the auxiliary device.

7. The method of claim 6 wherein said step of repositioning the removable cover and reattaching the removable cover at the enablement section comprises the steps of reattaching the removable cover at a location spaced from the attachment section.

8. The method of claim 6 wherein said step of repositioning the removable cover and reattaching the removable cover at the enablement section comprises the steps of reattaching the removable cover at a location at least partially overlying the attachment section.

9. In an image forming device including an attachment section at which an auxiliary device is attachable to the image forming device and a removable cover for covering the attachment section when no auxiliary device is attached to the attachment section, a method of preventing loss of the removable cover comprising the steps of:

configuring the auxiliary device or the image forming device so as to be inoperable when the auxiliary device is connected to the image forming device unless an enabling device is connected to the image forming device; and configuring the removable cover as the enabling device.

10. The method of claim 9 wherein said step of configuring the removable cover as the enabling device comprises the step of configuring the removable cover as a shock absorbing element for engaging an actuator on the auxiliary device.

11. The method of claim 9 wherein said step of configuring the removable cover as the enabling device comprises the step of configuring the removable cover as a reflective surface for reflecting a distance measuring light of the auxiliary device.

12. The method of claim 9 wherein said step of configuring the removable cover as the enabling device comprises the step of configuring the removable cover as a portion of a paper guide path between a paper source in the auxiliary device and a photoconductive drum in the image forming device.

13. In an image forming device including an attachment section at which an auxiliary device is attachable to the image forming device and a removable cover for covering the attachment section when no auxiliary device is attached to the attachment section, a method of using an enabling device to connect the auxiliary device to the image forming device comprising:

configuring the auxiliary device or the image forming device so as to be inoperable when the auxiliary device is connected to the image forming device unless the enabling device is connected to the image forming device; and using the removable cover as the enabling device.

14. The method of claim 13 wherein said step of using the removable cover as the enabling device comprises the step of configuring the removable cover as a shock absorbing element for engaging an actuator on the auxiliary device.

15. The method of claim 13 wherein said step of using the removable cover as the enabling device comprises the step of configuring the removable cover as a reflective surface for reflecting a distance measuring light of the auxiliary device.

16. The method of claim 13 wherein said step of using the removable cover as the enabling device comprises the step of configuring the removable cover as a portion of a paper guide path between a paper source in the auxiliary device and a photoconductive drum in the image forming device.

* * * * *